US006382329B2

(12) United States Patent
Pitts

(10) Patent No.: US 6,382,329 B2
(45) Date of Patent: May 7, 2002

(54) BALLAST PLOW

(76) Inventor: John G. Pitts, #8 Jesse James, Belton, TX (US) 76513

( * ) Notice: Subject to any disclaimer, the term of this patent is extended or adjusted under 35 U.S.C. 154(b) by 0 days.

(21) Appl. No.: 09/797,669

(22) Filed: Mar. 5, 2001

Related U.S. Application Data

(63) Continuation-in-part of application No. 09/304,647, filed on May 4, 1999, now abandoned.

(51) Int. Cl.[7] ..... E02F 3/12; E02F 3/64; E02F 3/26

(52) U.S. Cl. ..... 172/784; 37/105; 37/106

(58) Field of Search ..... 37/107, 105, 106, 37/381; 105/238.1, 463.1; 172/666, 789, 347, 684.5, 382, 784, 305, 197; 56/15.2; 405/180; 414/718; 171/16

(56) References Cited

U.S. PATENT DOCUMENTS

| | | | | | |
|---|---|---|---|---|---|
| 2,374,312 | A | * | 4/1945 | Tackett | 37/104 |
| 2,491,797 | A | * | 12/1949 | Burns et al. | 37/105 |
| 2,599,480 | A | * | 6/1952 | Seminario | 37/382 |
| 2,601,380 | A | * | 6/1952 | Flory | 172/347 |
| 3,019,536 | A | * | 2/1962 | Kershaw | 37/104 |
| 3,049,817 | A | * | 8/1962 | MacDonald | 37/381 |
| 3,257,744 | A | * | 6/1966 | Bühler | 37/105 |
| 3,445,944 | A | * | 5/1969 | Speno | 37/105 |
| 3,726,347 | A | * | 4/1973 | Hyman | 172/666 |
| 3,815,268 | A | * | 6/1974 | Yard | 37/105 |
| 4,196,532 | A | * | 4/1980 | Muller | 37/105 |
| 4,279,312 | A | * | 7/1981 | Pyle | 172/789 |
| 4,821,810 | A | * | 4/1989 | Buchanan | 172/197 |
| 4,852,659 | A | * | 8/1989 | Ross et al. | 172/789 |
| 4,854,811 | A | * | 8/1989 | Veys | 414/718 |
| 4,890,958 | A | * | 1/1990 | Dancer | 405/180 |
| 4,953,625 | A | * | 9/1990 | Hurworth | 172/305 |
| 5,210,997 | A | * | 5/1993 | Mountcastle, Jr. | 56/15.2 |
| 5,392,593 | A | * | 2/1995 | Emery | 56/15.2 |
| 5,427,185 | A | * | 6/1995 | Seal | 172/684.5 |
| 5,435,081 | A | * | 7/1995 | Hannes | 37/106 |
| 5,533,283 | A | * | 7/1996 | Roth | 37/142.5 |

* cited by examiner

*Primary Examiner*—Robert E. Pezzuot
*Assistant Examiner*—Árpád Fábián Kovács
(74) *Attorney, Agent, or Firm*—Patent & Trademark Services; Joseph H. McGlynn

(57) ABSTRACT

A ballast plow that is attached to a KERSHAW ballast regulator wing. The plow will be attached to the wing so that it can be moved toward and away from the wing, and in addition, it can be moved up and down and can be rotated from side to side. The plow will allow the device to extend its reach to an area outside the normal ballast area of a railroad track and to clear away brush and small trees which might impinge upon the ballast area. The plow reclaims ballast, drainage, and creates an improved walkway, thus providing a safe working area.

13 Claims, 1 Drawing Sheet

BALLAST PLOW

This is a CIP of Ser. No. 09/304,647, filed May 4, 1999, now abandoned Mar. 6, 2002.

BACKGROUND OF THE INVENTION

This invention relates, in general, to graders, and, in particular, to right of way graders that can be used in conjunction with railroad cars.

DESCRIPTION OF THE PRIOR ART

In the prior art various types of graders have been proposed. For example, U.S. Pat. No. 3,257,744 to Bohler discloses a blade attached to a railway car and which is movable toward and away from the side of the car by means of a line on a pulley system.

U.S. Pat. No. 3,445,944 to Speno discloses a side plow which has a blade attached to a railway car and is movable perpendicular to the longitudinal axis of the car.

U.S. Pat. No. 3,726,347 to Hyman discloses a grader with a wheel that engages a guide member to move the grader perpendicular to the longitudinal axis of the car.

U.S. Pat. No. 3,815,268 to Yard discloses a ballast box which is attached to a railway car and is moved toward and away from the car by a line on a pulley system and hydraulic cylinders.

U.S. Pat. No. 4,196,532 to Muller discloses a device for leveling a railroad right of way by means of a blade which is moved by hydraulic cylinders.

U.S. Pat. No. 5,435,081 to Hannes discloses a grader attached to a railway car by means of a ram which cab be vertically adjusted with respect to the railway car.

SUMMARY OF THE INVENTION

The present invention is directed to a right of way grader that is attached to a vehicle such as, but not limited to a KERSHAW ballast regulator wing. The grader will be attached to the wing so that it can be moved toward and away from the wing, and in addition, the blade attached to the grader can be rotated. The grader will allow the device to extend its reach to an area outside the normal ballast area of a railroad track and to clear away brush and small trees which might impinge upon the ballast area.

It is an object of the present invention to provide a new and improved grader which can be attached to a railway vehicle to clear brush and small trees from the right of way.

It is an object of the present invention to provide a new and improved grader which can be adjusted with respect to the railway vehicle, and in addition, it can be moved up and down and can be rotated from side to side.

It is an object of the present invention to provide a new and improved grader which clears right of way of brush and other debris for a safer work or walking area.

It is an object of the present invention to provide a new and improved grader which recovers ballast that is too far away for a conventional regulator wing, thereby saving time and money which would be expended in unloading and applying new ballast.

It is an object of the present invention to provide a new and improved grader which would be useful in clearing snow from the right of way.

These and other objects and advantages of the present invention will be fully apparent from the following description, when taken in connection with the annexed drawings.

DESCRIPTION OF THE PREFERRED EMBODIMENT

Figure 1:
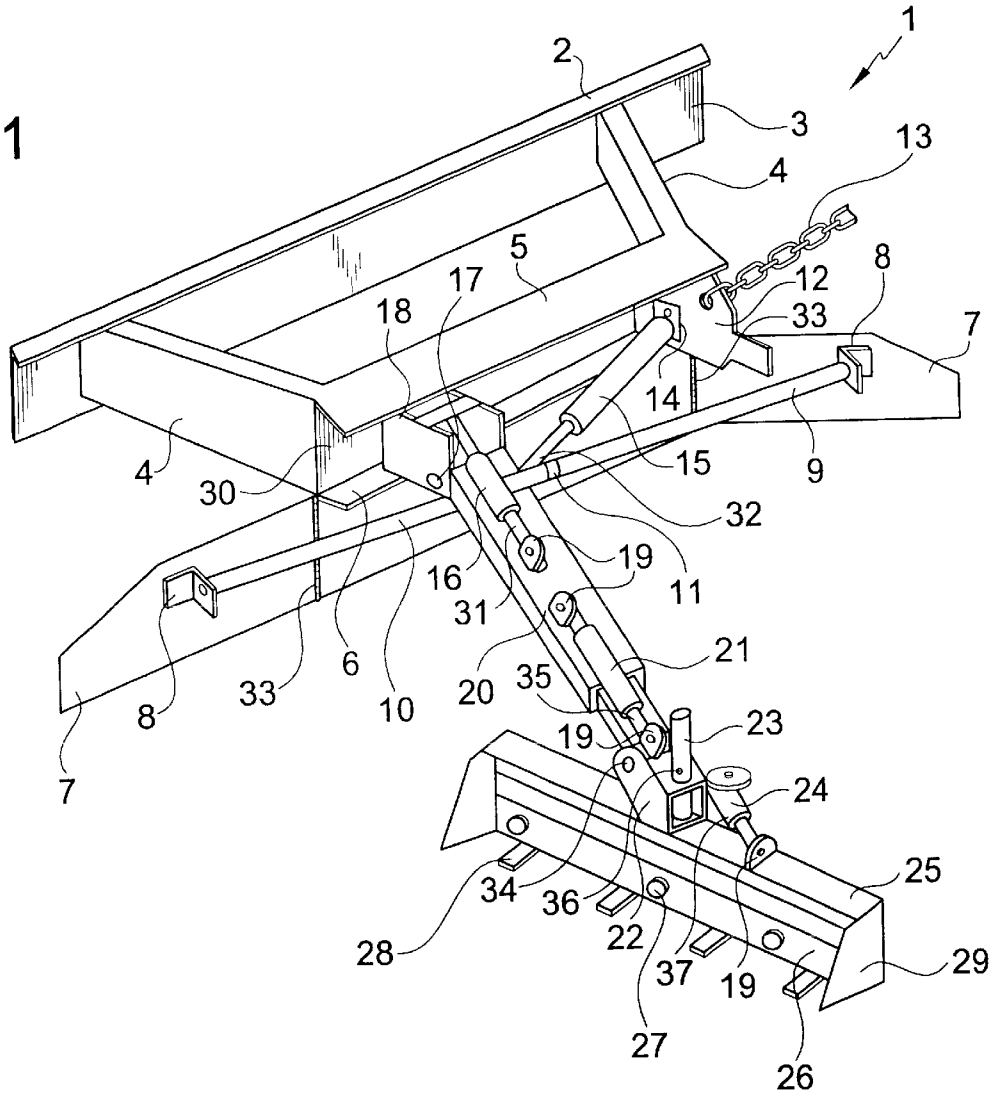
FIG. 1 is a perspective view of the present invention.

Referring now to the drawings in greater detail, the FIGURE shows the present invention 1 which can be attached to any type of railway vehicle. The grader of the present invention has a base 2, 3 which can be attached to a railway vehicle in any conventional manner. The base 2, 3 has a pair of side flanges 4 which extend from the base 2, 3 at an angle, and a support member 30 is attached to the ends of the side flanges 4. The support member 30 has an upper rail 5 and a lower rail 6. A boom support 18 is designed to fit between the upper and lower rails 5, 6 so it can slide from one side of the support member 30 toward the other side of the support member 30.

The boom support 18 receives an extension arm 20 which is pivotally secured to the boom support 18 by any conventional means such as, but not limited to, a pivot pin 17, which can be secured through aligned apertures in the boom support 18 and the extension arm 20. The apertures that receive the pin 17 are not seen in the FIGURE since they are hidden by other details of the boom support 18 and the extension arm 20. However, this type of pivoting structure is well known to persons of ordinary skill in the art.

A first hydraulic cylinder 16 is attached at one end to the boom support 18, by any conventional means, and the hydraulic cylinder 16 is attached at another end to the extension arm 20 by a bracket 19. The bracket 19 can be secured to the extension arm 20 by any conventional means. Because of the way the hydraulic cylinder is attached to the boom support 18 and the extension arm 20, when the conventional hydraulic cylinder arm 31 is extended, it will cause the extension arm 20 to pivot downwardly about the longitudinal axis of the pivot pin 17. When the hydraulic cylinder arm 31 is retracted, it will cause the extension arm 20 to pivot upwardly about the longitudinal axis of the pivot pin 17. In this manner, i.e. by extending and retracting the hydraulic cylinder arm 31, the operator of the present invention 1 can control how close to the ground the blade 26 will be positioned.

It should be noted that all of the hydraulic cylinders (16, 21, 24 and 15) are conventional cylinders that are controlled by hydraulic oil circuits and valves mounted in the railway vehicle (not shown). In the usual manner with such cylinders, hydraulic oil is supplied to the cylinders from either a separate source or from the hydraulic system of the railway vehicle. The oil is supplied to the cylinders (16, 21, 24 and 15) by means of separate oil lines which are attached to the individual cylinders in any conventional manner. The oil lines are not shown in the FIGURE for reasons of clarity, however, since the oil lines are conventional and attached in a conventional manner any person of ordinary skill in the art would instantly know how to attach and use the oil lines and cylinders. Therefore, such a showing is unnecessary and if shown would obscure more important details of the present invention.

The position of the extension arm 20 with respect to the support member 30 is also controlled by a second hydraulic cylinder 15. The second hydraulic cylinder 15 is connected to a support member side flange 12 by means of a bracket 14, and the hydraulic cylinder arm 32 of the second hydraulic cylinder is secured to the extension arm 20 in any conventional manner. Therefore, when the extension arm 32 is retracted into the cylinder 15, the extension arm 20 will move toward the side flange 12. When the extension arm 32 is extended out of the cylinder 15, the extension arm 20 will move away from the side flange 12. In this manner the operator can control the position of the blade 26 with respect to the support member 30. It should be noted that the second hydraulic extension arm 32 is shown in the FIGURE to be attached to the extension arm, however, it could instead be attached to the boom support 18 which would result in the same type of operator control.

Also, it should be noted that the length of the second hydraulic cylinder 15 and arm 32 can be varied to provide more or less movement of the extension arm 20 with respect to the support member 30. Since the second hydraulic cylinder 15 and arm 32 are mounted at an angle to the extension arm 20, they will hold the extension arm 20 and the boom support 18 against the support member 30 due to the force vectors created by the second hydraulic cylinder 15 and arm 32. Since force vectors are a well known engineering concept no further description is necessary or will be given.

In addition, the support member side flange 12 has a chain 13 attached thereto in any conventional manner. Only a portion of the chain 13 is shown in the FIGURE, for purposes of clarity, however, it should be noted that the length of the chain would be selected so it can be wrapped around the extension arm 20 and secured thereto in any conventional manner to hold the extension arm while the railway vehicle (not shown) is being moved from one job site to another. This will lessen any strain on the hydraulic system which would normally be used to hold the extension arm in a selected position.

As shown in the FIGURE, the lower portion of the support member 30 has a pair of lower side flanges 7 which are pivotally attached to the support member 30 by hinges 33. The lower side flanges 7 are connected together by a pair of telescoping rods 9, 10 which are attached to the lower side flanges 7 by brackets 8. The side flanges 7 can be adjusted by adjusting the length of the telescoping rods 9, 10 to engage and collect ballast.

A blade support bracket 22 is attached to the end of the arm 20 by a pivot pin 34. A third hydraulic cylinder 21 is secured to the extension arm 20 by means of a bracket 19, and a third hydraulic extension arm 35 is secured to the blade support bracket 22 by a bracket 19. When the third hydraulic extension arm 35 is extended from the third hydraulic cylinder, this will cause the blade support bracket 22 to pivot about the pivot pin 34.

The blade support bracket 22 receives a blade support column 23. The column 23 is attached to the blade support 29 by any conventional means. The column 23 is inserted through apertures in the bottom and top of the blade support bracket 22 and a pin 36 is passed through apertures in the blade support column 23 to prevent the blade support column from passing back through the apertures in the blade support bracket 22.

A fourth hydraulic cylinder 24 is attached at one end to the blade support bracket 22 by any conventional means. A fourth hydraulic extension arm 37 is connected to the blade support 25 by means of a bracket 19. The blade support 25 has side wings 29 attached at opposite ends of the blade support. The side wings 29 are for creating a box blade and can be removable by any conventional means. Side wings 29 make it possible to evenly distribute fine materials, ballast, mounds of dirt, etc.

When the fourth hydraulic extension arm 37 is retracted into the fourth hydraulic cylinder 24, this will cause the blade support 25 to pivot about the vertical axis of the blade support column 23 in a counterclockwise direction. When the fourth hydraulic extension arm 37 is extended from the fourth hydraulic cylinder 24, this will cause the blade support 25 to pivot about the vertical axis of the blade support column 23 in a clockwise direction. This will give the operator control over the angle of the blade 26 with respect to the extension arm 20.

The blade 26 is attached to the blade support 25 by means of threaded fasteners 27. The blade 26 is double sided so when one side (the side closest to the ground in the FIGURE) becomes dull, the blade can be removed from the blade support 25, by removing the threaded fasteners 27, flipped over and reassembled on the blade support 25 by reinserting the threaded fasteners 27. This will allow the blade to last longer before it has to be resharpened, thereby prolonging the useful life of the blade. In addition, teeth 28 can be attached to the blade support 25 in order to increase the cutting or scraping power of the blade 26. The teeth 28 are detachably attached to the blade and can be attached in the down position (the position shown in the FIGURE) or the teeth can be reversed and put in an up position, i.e. a position where the teeth will not be used, so they will be out of the way when doing normal grading.

Although the Right of Way Grader and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A right of way grader adapted to be attached to a railway vehicle, said right of way grader comprising:

means for attaching said right of way grader to a railway vehicle, a support member secured to said means for attaching said right of way grader to a railway vehicle, said support member having a length and a width, said support member having means for supporting a boom support, said means for supporting said boom support having means for moving said boom support back and forth along said support member, said boom support moving parallel to said length of said support member, and an arm attached to said boom support, means attached to said boom support and to said arm for adjusting a position of said arm with respect to said support member, and said arm is pivotally attached to said boom support, and said boom support extends generally perpendicular to said length of said support member, a blade attached to said arm.

2. The right of way grader as claimed in claim 1, wherein said support member has means for supporting said arm while said railway vehicle is in transit.

3. The right of way grader as claimed in claim 1, wherein said means for supporting said boom support on said support member is a pair of rails.

4. The right of way grader as claimed in claim 1, wherein said means for moving said boom support back and forth along said support member is a hydraulic cylinder.

5. The right of way grader as claimed in claim 1, wherein said means attached to said boom support and to said arm for adjusting a position of said arm with respect to said support member is a hydraulic cylinder.

6. The right of way grader as claimed in claim 1, wherein said arm has a blade support bracket attached thereto, and said blade is pivotally attached to said blade support bracket.

7. The right of way grader as claimed in claim 6, wherein said blade support bracket has means for adjusting said blade with respect to said arm.

8. The right of way grader as claimed in claim 7, wherein said means for adjusting said blade with respect to said arm is a hydraulic cylinder.

9. The right of way grader as claimed in claim 1, wherein blade has a plurality of teeth attached thereto.

10. A right of way grader adapted to be attached to a railway vehicle, said right of way grader comprising:

means for attaching said right of way grader to a railway vehicle, a support member secured to said means for attaching said right of way grader to a railway vehicle, said support member having a length and a width, said support member having means for supporting a boom support, said means for supporting said boom support having means for moving said boom support back and forth along said support member, said boom support moving parallel to said length of said support member, and an arm attached to said boom support, means attached to said boom support and to said arm for adjusting a position of said arm with respect to said support member, and said arm is pivotally attached to said boom support, and said boom support extends generally perpendicular to said length of said support member, a blade attached to said arm, and wherein said means for supporting said boom support on said support member is a pair of rails, and wherein said means for moving said boom support back and forth along said support member is a hydraulic cylinder.

11. The right of way grader as claimed in claim 10, wherein said blade has a plurality of teeth attached thereto.

12. A right of way grader adapted to be attached to a railway vehicle, said right of way grader comprising:

means for attaching said right of way grader to a railway vehicle, a support member secured to said means for attaching said right of way grader to a railway vehicle, said support member having a length and a width, said support member having means for supporting a boom support, said means for supporting said boom support having means for moving said boom support back and forth along said support member, said boom support moving parallel to said length of said support member, and an arm attached to said boom support, means attached to said boom support and to said arm for adjusting a position of said arm with respect to said support member, and said arm is pivotally attached to said boom support, and said boom support extends generally perpendicular to said length of said support member, a blade attached to said arm, and wherein said arm has a blade support bracket attached thereto, and said blade is pivotally attached to said blade support bracket, and wherein said blade support bracket has means for adjusting said blade with respect to said arm, and wherein said means for adjusting said blade with respect to said arm is a hydraulic cylinder.

13. The right of way grader as claimed in claim 12, wherein said blade has a plurality of teeth attached thereto.

* * * * *